US006514297B1

(12) United States Patent
Moreton et al.

(10) Patent No.: US 6,514,297 B1
(45) Date of Patent: Feb. 4, 2003

(54) DETERGENTS FOR USE IN PREVENTING FORMATION OF IRON COMPLEXES IN HYDROCARBON FUELS

(75) Inventors: David John Moreton, East Yorkshire (GB); Rodney J. McAtee, Derbyshire (GB)

(73) Assignee: The Lubrizol Corporation, Wickliffe, OH (US)

( * ) Notice: Subject to any disclaimer, the term of this patent is extended or adjusted under 35 U.S.C. 154(b) by 0 days.

(21) Appl. No.: 09/448,251

(22) Filed: Nov. 24, 1999

(51) Int. Cl.[7] ..... C10L 1/22

(52) U.S. Cl. ..... 44/415; 508/542; 556/26; 564/367; 564/368

(58) Field of Search ..... 508/542; 556/26; 564/367, 368; 44/415

(56) References Cited

U.S. PATENT DOCUMENTS

| | | | | | |
|---|---|---|---|---|---|
| 3,634,515 | A | * | 1/1972 | Piasek et al. | 564/368 |
| 3,649,659 | A | * | 3/1972 | Otto et al. | 556/26 |
| 4,117,011 | A | | 9/1978 | Malec | 260/570.5 P |
| 4,425,245 | A | | 1/1984 | Cahill et al. | 252/33 |
| 5,399,178 | A | | 3/1995 | Cherpeck | 44/415 |
| 5,876,468 | A | | 3/1999 | Moreton | 44/415 |

FOREIGN PATENT DOCUMENTS

| | | | |
|---|---|---|---|
| CA | 2089833 | | 7/1993 |
| EP | 476196 | A1 | 3/1992 |
| EP | 0647700 | A1 | 4/1995 |
| EP | 681023 | A1 | 11/1995 |
| WO | 89/07126 | | 8/1989 |
| WO | 91/13950 | | 9/1991 |

OTHER PUBLICATIONS

Derwent Patent Abstract, accession No. 1990–298088.

Critical Reports on Applied Chemistry, vol. 25, Gasoline and Diesel Fuel Additives, Edited by K. Owen, Published by John Wiley & Son, Jul. 1990, pp. 12–13.

* cited by examiner

*Primary Examiner*—Cephia D. Toomer
(74) *Attorney, Agent, or Firm*—Michael F. Esposito; Jeffrey F. Munson; Samuel B. Laferty

(57) ABSTRACT

An improved detergent for use in hydrocarbon fuels comprising the composition produced by mixing (1) the Mannich reaction product of a polyisobutene-substituted phenol, (preferably, where the polyisobutene from which the substituted phenol is derived contains at least 70% terminal olefinic double bonds of the vinylidene type); an aldehyde; and an amine, preferably, ethylene diamine; and (2) a compound selected from the group consisting of an alkylbenzene sulfonic acid, an alkylnapthalene sulfonic acid, acetylaetone and mixtures thereof. Preferably, the alkylbenzene and alkylnapthalene sulfonic acid is selected to be a ($C_6$ to $C_{18}$) alkylbenzene sulfonic acid/napthalene sulfonic acid, especially preferred being dodecylbenzene sulfonic acid.

40 Claims, No Drawings

DETERGENTS FOR USE IN PREVENTING FORMATION OF IRON COMPLEXES IN HYDROCARBON FUELS

BACKGROUND OF THE INVENTION

The present invention relates to improved detergents for use in hydrocarbon fuels. In particular, the present invention is directed to an improved detergent useful in the prevention of iron complexes in hydrocarbon fuel.

Hydrocarbon fuels generally contain numerous deposit-forming substances. When used in internal combustion engines, deposits tend to form on and around constricted areas of the engine in contact with the fuel. In diesel engines, deposits tend to accumulate in the fuel injection system, thereby hampering good performance of the engine. In automobile engines, deposits can build up on engine intake valves leading to progressive restriction of gaseous fuel mixture flow into the combustion chamber and also to valve sticking. It is common practice, therefore, to incorporate a detergent in the fuel composition for the purpose of inhibiting the formation, and facilitating the removal, of engine deposits, thereby improving engine performance. Certain Mannich condensation products, obtained by reacting hydrocarbon-substituted phenols, aldehydes and amines, are known as detergents for fuels. These have an advantage over polyisobutene amine detergents in that they are substantially chlorine free.

U.S. Pat. No. 4,117,011 discloses Mannich condensation products obtained by reacting hydrocarbon-substituted phenols, aldehydes, amines and alkylene oxides as dispersants/detergents for lubricating oils and hydrocarbon fuels. Preferred reactants include polyisobutene-substituted phenols, formaldehyde, and alkylene polyamines such as diethylene triamine which, in one process, are combined in a Mannich condensation reaction before being reacted with a polyalkylene oxide.

CA-A-2089833 and EP-A-647700 both disclose fuel compositions containing detergent additives which comprise Mannich reaction products of a polyisobutene-substituted phenol, an amine and an aldehyde, the amine preferably being an alkylene polyamine such as diethylene triamine, triethylene tetramine and the like. Although ethylene diamine is mentioned in EP-A-647700 as a possible amine, no compounds employing it are disclosed, and it is not amongst the preferred amines; nor is there any mention in either of these documents of the nature of the polyisobutene employed.

U.S. Pat. No. 5,876,468 is directed to the discovery that Mannich condensation products of particular polyisobutene-substituted phenols, an aldehyde and ethylene diamine are especially good detergents in fuels, and significantly better than those described in the above-mentioned prior art. The present invention is directed to an improvement in detergents suitable for use with hydrocarbon fuels, especially detergents of the type disclosed in the U.S. Pat. No. 5,876,468.

SUMMARY OF THE INVENTION

It is the primary object of the present invention to provide a novel detergent for use in hydrocarbon fuels.

It is another object of the present invention to provide a process for preventing the formation of iron complexes in hydrocarbon fuels utilizing the novel detergent.

It is a further object of the present invention to provide a process for the manufacture of the novel detergent of the present invention.

Additional objects and advantages of the present invention will be set forth in part in the description which follows and, in part, will be obvious from the description or may be learned by the practice of the invention. The objects and advantages of the invention may be realized and attained by means of the instrumentalities and combinations particularly pointed out in the appended claims.

To achieve the foregoing objects and in accordance with the purpose of the invention as embodied and broadly described herein, the improved detergent of the present invention comprises a composition comprising the reaction product of (1) the Mannich reaction product of a polyisobutene-substituted phenol, an aldehyde, and an amine; and (2) a compound selected from the group consisting of alkylbenzene sulfonic acids, alkylnapthalene sulfonic acids, acetylacetone and mixtures thereof.

In a preferred enbodiment of the present invention the alkyl group is selected form the range of $C_6$ to $C_{18}$, more preferably $C_8$ to $C_{14}$, and especially preferred being $C_{10}$ to $C_4$.

In another preferred embodiment of the aspect of the present invention, the polyisobutene from which the substituted phenol is derived is selected to contain terminal olefinic double bonds of the vinylidene type, preferably greater than 50%, especially preferred being greater than 70%.

In a further preferred embodiment of this aspect of the present invention, the amine is selected to be an alkylene polyamine, preferably ethylene diamine, diethylene diamine, triethylene diamine, especially preferred being ethylene diamine.

In a still further preferred embodiment of this aspect of the present invention, the compound is added in the range of greater than 0 to 1000 ppm, preferably 20 to 100 ppm, especially preferred being 40 to 80 ppm Another aspect of the present invention comprises a fuel composition comprising a major amount of hydrocarbon fuel including 10 to 1000 ppm of the above-described detergent mixture.

A still further aspect of the present invention comprises a method of preventing the formation of iron complexes in a fuel comprising a major amount of a hydrocarbon fuel and a Mannich reaction product of a polyisobutene-substituted phenol where the polyisobutene from which the polyisobutene substituted phenol is derived contains at least 50% terminal double bonds of the vinylidene type comprising adding about 3.0 to 20 ppb of the compound to said fuel, preferably about 3 to 16 ppb.

Reference will now be made in detail to the present preferred embodiment of the invention.

DETAILED DESCRIPTION OF THE INVENTION

The following description of the present invention will primarily be directed to the use of polyisobutene (PiBs) having at least 70% of the terminal olefinic double bonds which are of the vinylidene type. However, it should be understood that other PiBs having less than 70% vinylidene type terminal olefinic double bonds may be utilized in the composition of the present invention. For example, PiB's having 50% or less terminal olefinic double bonds which are of the vinylidene type may be suitable in the practice of the invention.

PiBs in which at least 70% of the terminal olefinic double bonds are of the vinylidene type are commonly known as "high reactive" polyisobutenes, as distinct from "low reactive" PiBs (having a lower proportion of vinylidene terminal double bonds which are commonly used. Examples of "high reactive" polyisobutenes include Ultravis® marketed by BP Chemicals and Glissopal® marketed by BASF. The composition of the invention is particularly useful when the Mannich reaction product is formed from the reaction of ethylene diamine, formaldehyde and a PiB substituted phenol in which the PiB is highly reactive. The combination of the Mannich reaction product with or without the alkylbenzenesulfonic acid and/or aklylnapthalenesulfonic acid and/or acetylacetone provide surprisingly superior performance to known fuel detergents based on Mannich chemistry. However, the presence of the alkylbenzenesulfonic acid and/or aklylnapthalenesulfonic acid and/or acetylacetone provide the additional advantage of preventing the formation of iron complexes where the detergent is brought into contact with mild steel containers. This additional advantage substantially eliminates the need for storing the detergent of the present invention in stainless steel or plastic containers, thereby enabling the material to be stored in conventional steel-based containers.

Preferably, the PiB has a number average molecular weight of from 700 to 2300, particularly from 750 to 1500, especially preferred being from 900 to 1300. The aldehyde is preferably a ($C_1$–$C_6$) aldehyde, most preferably formaldehyde.

As mentioned above, the composition of the invention is made by admixing one component comprising a Mannich reaction product and a second component selected from the group consisting of alkylbenzene sulfonic acids, alkylnapthalene sulfonic acids, acetylacetone and mixtures thereof. The conditions required for Mannich reactions are well known in the art, for example, see U.S. Pat. No. 4,117,011 herein incorporated by reference.

Another aspect of the present invention provides a process for producing a composition as defined above, comprising mixing (1) the Mannich Reaction Product made by reacting together a polyisobutene phenol, an aldehyde, and ethylene diamine under conditions suitable for a Mannich condensation reaction with (2) a compound selected from the group consisting of selected from the group consisting of an alkylbenzene sulfonic acid, alkylnapthalene sulfonic acids, acetylacetone and mixtures thereof. The amount of alkylbenzene sulfonic acids/alkylnapthalene sulfonic acids/acetylacetone ranges from greater than 0 to 1000, preferably 20 to 100, especially preferred being 40 to 80 ppm.

It is preferred that the composition of the invention is present in the fuel composition in the form of an additive package, the package being present at a level of from 200 to 3000 ppm, preferably from 600 to 1000 ppm. Thus, another aspect of the invention provides an additive package for a fuel composition, comprising from 5 to 30% by weight of the composition as defined above, a carrier fluid, and optionally a solvent, preferably an aromatic or aliphatic hydrocarbon solvent. Suitable carrier fluids include alkyl phenols, optionally alkoxylated; esters of acids/alcohols, acids/polyols or acids/glycol ethers, the acids being saturated or unsaturated; phthalate esters; trimellitate esters; alkoxylated alcohols or polyols; polyalkylene glycols; and lubricating oils. Suitable solvents may include most known aromatic (e.g. xylene, toluene) or aliphatic hydrocarbons (e.g. hexane, pentane, octane ) or glycol ethers. The invention also comprises in a still further aspect the use of the above composition and additive packages as detergents in hydrocarbon fuels.

The hydrocarbon fuel may suitably comprise a hydrocarbon fraction boiling in the gasoline range or a hydrocarbon fraction boiling in the diesel range. Gasolines suitable for use in spark ignition engines, e.g. automobile engines, generally boil in the range from 30° to 230° C. Such gasolines may comprise mixtures of saturated, olefinic and aromatic hydrocarbons. They may be derived from straight-run gasoline, synthetically produced aromatic hydrocarbon mixtures, thermally or catalytically cracked hydrocarbon feedstocks, hydrocracked petroleum fractions or catalytically reformed hydrocarbons. The octane number of the base fuel is not critical and will generally be above 65. In the gasoline, hydrocarbons may be replaced in part by alcohols, ethers, ketones or esters, typically in an amount up to 20% by weight. Alternatively, the liquid hydrocarbon fuel may comprise any diesel fuel suitable for operating spark compression engines, such as those which may be found in road vehicles, ships and the like. Generally, such diesel fuel will boil in the range from about 140° C. to about 400° C. (at atmospheric pressure), particularly in the range from about 150° to. 390° C., especially from about 175° to 370° C. Such fuels may be obtained directly from crude oil (straight-run) or from a catalytically or thermally cracked product or a hydrotreated product, or from a mixture of the aforesaid. Alternatively, there may be used a biofuel, for example rape seed methyl ester. The cetane number will typically be in the range from 25 to 60.

The fuel contains the detergent composition of the present invention in an amount sufficient to provide dispersancy. Typically, in a gasoline fuel this amount will be in the range from 20 to 1000 ppm w/w based on the total weight of the fuel. Typically, in a diesel fuel, this amount will be in the range from 10 to 500 ppm w/w based on the total weight of the diesel fuel.

The fuel composition may suitably be prepared by blending a concentrate composition comprising a fuel compatible hydrocarbon solvent and the composition with the hydrocarbon fuel.

The fuel composition, in addition to the composition of the present invention, may contain known additives. The nature of the additives will depend to some extent on the end-use of the fuel composition. Diesel fuel compositions may contain nitrates or nitrites as a cetane improver, or copolymers of ethylene and/or vinylesters, e.g. vinylacetate, as a pour point depressant. Gasoline fuel compositions may contain a lead compound as an anti-knock additive and/or an antioxidant, e.g. 2,6-di-tert-butyl phenol, and/or an anti-knock compound other than a lead compound, and/or an additional dispersant, for example a PiB polyamine. The other additives (if any) may be blended directly into the fuel composition or may be incorporated by way of a concentrate composition.

The invention will now be further illustrated by reference to the following examples. It should be noted that the comparative examples below all employ Ultravis® 10, a highly reactive polyisobutene, whereas equivalent compounds in the prior art are not disclosed as using a highly reactive polyisobutene and would, therefore, be expected to perform worse in these tests.

EXAMPLE 1 COMPARATIVE

A 250 ml flask was charged with 80 g of a 50% solution of the Mannich Reaction Product prepared by reacting a polyisobutene substituted phenol (Ultravis® 10) formaldehyde and ethylenediamine in hexane, 0.5 g powdered iron and 0.2% wt./wt. water. The mixture was heated to 50° C. for 14 hours on a steam bath with a condenser on the flask. The solution was then left to stand for 62 hours at 22° C.

EXAMPLE 2

A second composition was prepared using the same ingredients and apparatus as set forth in Example 1 with the addition of 60 ppm dodecylbenzenesulfonic acid (DBSA). The ingredients were heated in the flask for 3 weeks at 50° C.

The iron contents of the two solutions were then measured. The composition of Example 1 contained 281 ppm Fe while the composition of Example 2 had less than 5 ppm Fe. The results clearly indicate that DBSA had prevented iron complexes in the composition.

In addition, the following engine tests were undertaken to ensure that no detrimental effects were observed utilizing the composition of the present invention The Mannich reaction product was made into the following packages. Package 1: 17% w/w Mannich reaction product of Ultravis 10 Phenol, formaldehyde and ethylene diamine, 37.7% w/w dodecylphenol 11 mole propoxylate, 4.5% dodecylphenol and 40.8% mixed high boiling aromatic and aliphatic solvent. Package 2: The same as Package 1 except that the Mannich reaction product contained 100 ppm w/w dodecylbenzene sulphonic acid (DBSA). These packages were run in M102E engine tests "back to back" under CEC (Coordinating European Council ) protocols in RF83-A-91 Batch 9 at the Biceri Engine Test House in England. The result of these test are set forth below in Table I

TABLE I

M102E Results of Examples 1 and 2

| Package | Treat | IVD Avg (mgs) | IX Rating |
|---|---|---|---|
| 1 | 4000 ppm V/V | 38.5 | 9.55 |
| 2 | 400 ppm V/V | 44.5 | 9.48 |

EXAMPLE 3

A composition was prepared using the same ingredients and apparatus as set forth in Example 1 with the addition of 60 ppm acetylacetone. The ingredients were heated in the flask for 3 weeks at 50° C. The iron contents of the composition of Example 3 was measured and found to less than 5 ppm Fe. The results clearly indicate that acetylacetone had prevented iron complexes in the composition.

It is should be understood that some of the materials described above may interact in the final formulation, so that the components of the final formulation may be different from those that are initially added. For instance, metal ions (of, e.g., a detergent) can migrate to other acidic sites of other molecules. The products formed thereby, including the products formed upon employing the composition of the present invention in its intended use, may not susceptible of easy description. Nevertheless, all such modifications and reaction products are included within the scope of the present invention. It is intended that the present invention encompasses the composition prepared by admixing the components described above.

What is claimed is:

1. A composition useful as a fuel additive comprising a reaction product comprising (1) a Mannich reaction product of a polyisobutene-substituted phenol, an aldehyde, and an amine; and (2) a compound selected from the group consisting of alkylbenzene sulfonic acids, alkylnaphthalene sulfonic acids, acetylacetone and mixtures thereof; wherein the compound ranges from 20 to 100 ppm; and wherein the compound prevents the formation of iron complexes in the composition.

2. The composition of claim 1 wherein the alkyl group of the alkylbenzene sulfonic acids and the alkylnaphthalene sulfonic acids is selected to range from $C_6$ to $C_{18}$.

3. The composition of claim 2 wherein the compound is selected to be an alkylbenzene sulfonic acid.

4. The composition of claim 3 wherein the compound is selected to be dodecylbenzene sulfonic acid.

5. The composition of claim 2 wherein the compound is selected to be an alkylnaphthalene sulfonic acid.

6. The composition of claim 1 wherein the compound is selected to be acetylacetone.

7. The composition of claim 1 wherein the polyisobutene from which the polyisobutene-substituted phenol is derived contains at least 50% vinylidene terminal double bonds.

8. The composition of claim 1 wherein the polyisobutene from which the polyisobutene-substituted phenol is derived contains at least 70% vinylidene terminal double bonds.

9. The composition of claim 8 wherein the alkyl group of the alkylbenzene sulfonic acids and the alkylnaphthalene sulfonic acids is selected to range from $C_6$ to $C_8$.

10. The composition of claim 9 wherein the compound is selected to be an alkylbenzene sulfonic acid.

11. The composition of claim 9 wherein the compound is selected to be dodecylbenzene sulfonic acid.

12. The composition of claim 9 wherein the compound is selected to be an alkylnaphthalene sulfonic acid.

13. The composition of claim 8 wherein wherein the compound is selected to be acetylacetone.

14. The composition according to claim 1 wherein the polyisobutene has a number average molecular weight of from 700 to 2300.

15. The composition according to claim 1 wherein the polyisobutene has a number average molecular weight of from 750 to 1500.

16. The composition according to claim 1 wherein the aldehyde is a ($C_1$–$C_6$) aldehyde.

17. The composition according to claim 1 wherein the aldehyde is formaldehyde.

18. The composition of claim 8 wherein the polyisobutene has a number average molecular weight of from 700–2300.

19. The composition of claim 8 wherein the polyisobutene has a number average molecular weight of from 750–2000.

20. The composition of claim 8 wherein the aldehyde is a ($C_1$–$C_6$) aldehyde.

21. The composition of claim 8 wherein the aldehyde is formaldehyde.

22. An additive package for a fuel comprising from 8 to 30% by weight of the composition of claim 1, a carrier fluid and a solvent.

23. An additive package for a fuel according to claim 22 wherein the carrier fluid is an alkoxylated alcohol, alkyl phenol, or mixtures thereof and the solvent is an aromatic solvent.

24. A composition comprising a hydrocarbon fuel, and the composition of claim 1 wherein the concentration of the composition of claim 1 in the fuel is from 10 to 1000 ppm by weight.

25. An additive package for a fuel comprising from 5 to 30% by weight of the composition of claim 8, a carrier fluid and a solvent.

26. An additive package for a fuel according to claim 25 wherein the carrier fluid is an alkoxylated alcohol, alkyl phenol or mixtures thereof, and the solvent is an aromatic solvent.

27. A composition comprising a hydrocarbon fuel, and the composition of claim 8 wherein the concentration of the composition of claim 8 in the fuel is from 10 to 1000 ppm by weight.

28. The process for making the composition of claim 1 comprising mixing (1) the reaction product obtained by reacting together a polyisobutene substituted phenol, an aldehyde and an amine under conditions suitable for a Mannich condensation reaction and (2) a compound selected from the group consisting of alkylbenzene sulfonic acids, alkylnaphthalene sulfonic acids, acetylacetone and mixtures thereof.

29. The product obtained by the process of claim 28.

30. A composition comprising a mixture of (1) a Mannich reaction product of a polyisobutene-substituted phenol, an aldehyde, and an amine; and (2) a compound selected from the group consisting of an alkylbenzene sulfonic acid, an alkylnaphthalene sulfonic acid, acetylacetone and mixtures thereof; wherein the compound ranges from 20 to 100 ppm.

31. The composition of claim 30 wherein the alkyl group of the alkylbenzene sulfonic acid and the alkylnaphthalene sulfonic acid is selected to range from $C_6$ to $C_{18}$.

32. The composition of claim 31 wherein the compound is selected to be an alkylbenzene sulfonic acid.

33. The composition of claim 32 wherein the compound is selected to be dodecylbenzene sulfonic acid.

34. The composition of claim 31 wherein the compound is selected to be the alkylnaphthalene sulfonic acid.

35. The composition of claim 30 wherein the compound is selected to be acetylacetone.

36. The composition of claim 30 wherein the polyisobutene-substituted phenol is derived from a polyisobutene which contains at least 70% vinylidene terminal double bonds.

37. The composition of claim 1 wherein the amine is selected to be an alkylene polyamine.

38. The composition of claim 37 wherein the alkylene polyamine is selected to be ethylene diamine.

39. The composition of claim 30 wherein the amine is selected to be an alkylene polyamine.

40. The composition of claim 39 wherein the alkylene polyamine is selected to be ethylene diamine.

* * * * *